US006149243A

United States Patent [19]

Chang

[11] Patent Number: 6,149,243

[45] Date of Patent: Nov. 21, 2000

[54] METHOD FOR MAKING A FRUIT-SHAPED BATH SCRUBBER

[76] Inventor: Che-Yuan Chang, Chang Hua Hsien, Taiwan

[21] Appl. No.: 09/309,294

[22] Filed: May 11, 1999

[30] Foreign Application Priority Data

Apr. 13, 1999 [TW] Taiwan ..... 88105815

[51] Int. Cl.[7] ..... A47K 7/02

[52] U.S. Cl. ..... 300/21; 15/229.11

[58] Field of Search ..... 15/209.1, 229.11, 15/229.12, 229.13; 300/21

[56] References Cited

U.S. PATENT DOCUMENTS

| | | | |
|---|---|---|---|
| 1,737,247 | 11/1929 | Kean | 15/229.11 |
| 2,857,610 | 10/1958 | Rympalski | 300/21 |
| 4,168,863 | 9/1979 | Hatcher | 300/21 |
| 4,462,135 | 7/1984 | Sanford | 15/229.12 |
| 5,465,452 | 11/1995 | Girardot et al. | 300/21 |
| 5,784,747 | 7/1998 | Girardot et al. | 15/209.1 |
| 5,850,662 | 12/1998 | Galvan-Garza | 15/209.1 |
| 5,916,408 | 6/1999 | Chen | 300/21 |
| 5,947,564 | 9/1999 | Chen | 300/21 |
| 6,038,727 | 3/2000 | Chen | 300/21 |

FOREIGN PATENT DOCUMENTS

| | | | |
|---|---|---|---|
| 976889 | 3/1951 | France | 15/229.11 |

*Primary Examiner*—Terrence R. Till
*Attorney, Agent, or Firm*—Browdy and Neimark

[57] ABSTRACT

A method for making a fruit-shaped bath scrubber makes use of an elastic tubular net having two open ends. One of the open ends is first folded toward other end such that the two open ends form a combination end, and that other end of the tubular net forms a first folding end. The combination end is then folded toward the first folding end. A tail end of the tubular net is then repeatedly folded toward the first folding end until the tubular net is entirely folded to be located beside the first folding end. A ring is partially inserted into the first folding end before a lashing strap is put through the top edge of the folded portion of the tubular net, the first folding end and the ring. The lashing strap is tightened to form the fruit-shaped bath scrubber.

5 Claims, 3 Drawing Sheets

METHOD FOR MAKING A FRUIT-SHAPED BATH SCRUBBER

FIELD OF THE INVENTION

The present invention relates generally to a bath scrubber, and more particularly to a method for making a fruit-shaped bath scrubber.

BACKGROUND OF THE INVENTION

The conventional methods for making a bath scrubber include a step in which a plurality of elastic tubular nets are disposed and stretched in a molding tool. The tubular nets are then pleated, stacked, turned over, lashed, and cut before the tubular nets are removed from the molding tool. The tubular nets are finally released to form a spherical object. The conventional methods described above call for the use of various molding tools, depending on the forms of the bath scrubbers. As a result, the conventional methods are not cost-effective.

The bath scrubbers made by the conventional methods are not versatile in form, thereby undermining the marketability of the bath scrubbers. In addition, the bath scrubbers made by the conventional methods are not provided with a means enabling a user thereof to hold them securely in the hand of the user.

SUMMARY OF THE INVENTION

The primary objective of the present invention is therefore to provide a method for making a fruit-shaped bath scrubber without the use of a special molding tool. As a result, the method of the present invention is relatively cost-effective.

It is another objective of the present invention to provide a method for making a bath scrubber of various unique forms so as to enhance the marketability of the bath scrubber.

It is still another objective of the present invention to provide a method for making a bath scrubber which can be held securely in the hand of a user thereof.

It keeping with the principle of the present invention, the foregoing objectives of the present invention are attained by a method comprising a first step in which an elastic tubular net of a predetermined length is prepared such that one open end of the tubular net is folded toward other open end of the tubular net, and that these two open ends are joined together. The other end of the tubular net is formed as a first folding end. The joined end is folded toward the first folding end for an appropriate length. The tail end of the tubular net is folded toward the first folding end until the entire tubular net is folded to be the side of the first folding end. A ring is inserted into the first folding end. A lashing strap is put through the top edge of the folded portion of the tubular net, the first folding end, and the ring before the lashing strap is tightened, thereby forming a bath scrubber.

DETAILED DESCRIPTION OF THE INVENTION

Figure 1:
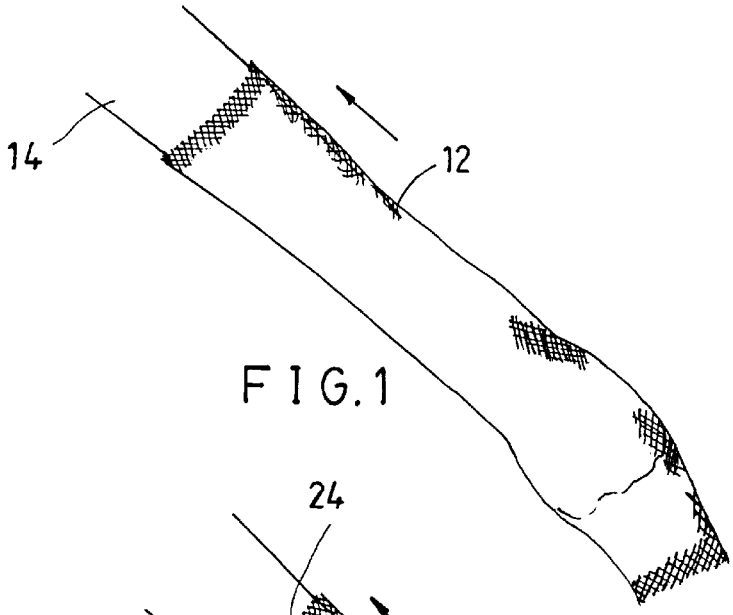
FIGS. 1–6 show schematic views of a first preferred embodiment of the present invention.
Figure 2:
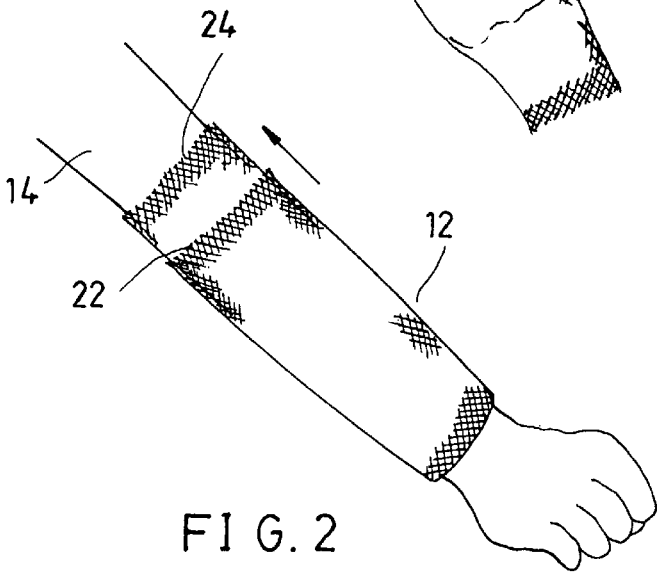
Figure 3:
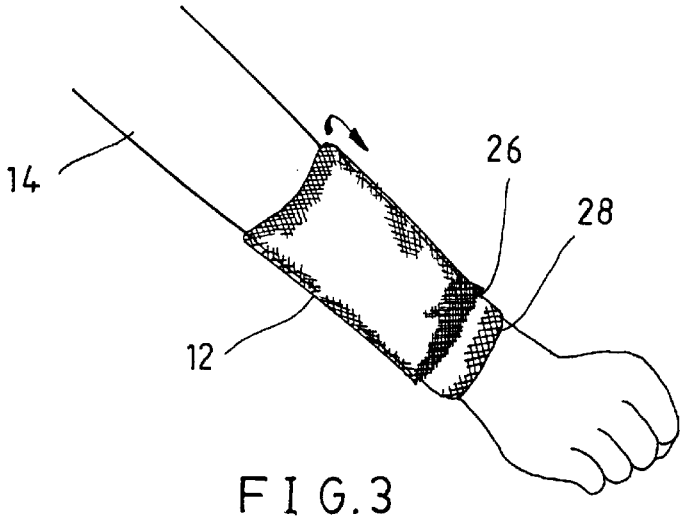
Figure 4:
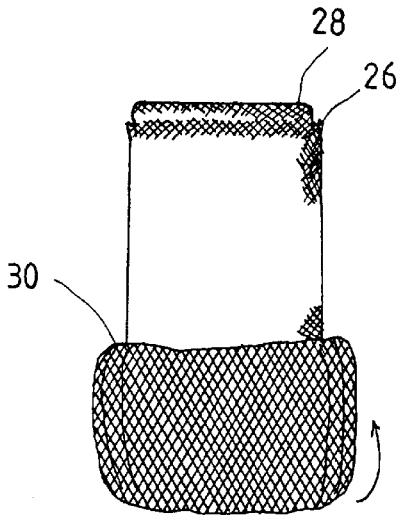
Figure 5:
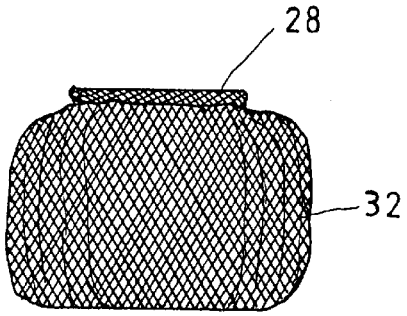
Figure 6:
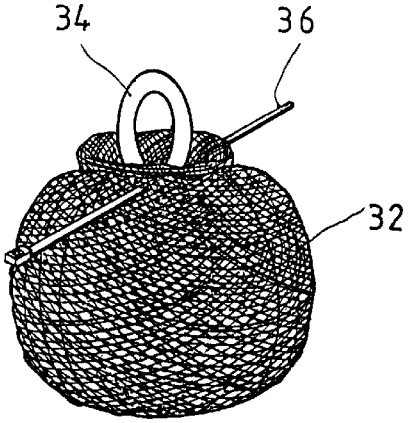
Figure 7:
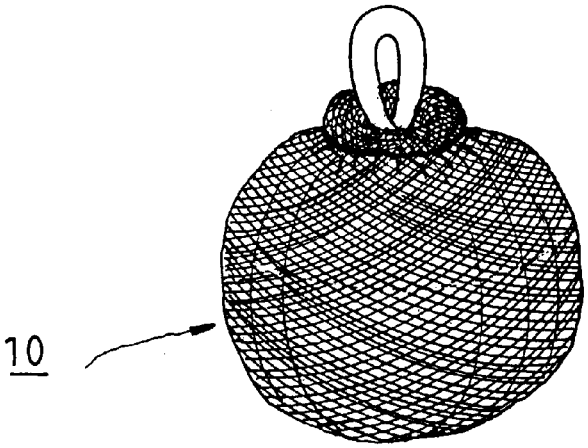
FIG. 7 shows a perspective view of a bath scrubber of the first preferred embodiment of the present invention.

As shown in FIGS. 1–7, a method embodied in the present invention comprises a first step in which an elastic tubular net 12 of an appropriate length is prepared. The tubular net 12 may be colored variously. The tubular net 12 is then braced by a support member 14, which may be a rod or human arm, before an open end 22 of the tubular net 12 is turned inside out such that the open end 22 is pulled upward to reach other end 24 of the tubular net 12, thereby causing these two open ends 22 and 24 to form a combination end 26. The other end of the tubular net 12 forms a first folding end 28. Thereafter, the combination end 26 is folded downward to reach the proximity of the first folding end 28, thereby forming a second folding end 30 at the place where the folding takes place. The tubular net 12 is subsequently removed from the human arm serving as the support member 14. The second folding end 30 is then repeatedly folded in a direction toward the first folding end 28 until the top edge of a folded portion 32 is contiguous to the first folding end 28. A ring 34 is partially inserted into the first folding end 28 such that a portion of the ring 34 is jutted out of the first folding end 28. One end of a lashing strap 36 is put through the top edge of the folded portion 32, the first folding end 28 and the ring 34 such that the end of the lashing strap 36 circumvents the top edge of the folded portion 32 before the lashing strap 36 is tightened. As a result, a fruit-shaped bath scrubber 10 is formed. The bath scrubber 10 so formed by the method of the present invention is attractive to its user, especially a child. In the meantime, the ring 34 serves as a means for holding securely the bath scrubber 10 by hand.

Figure 8:
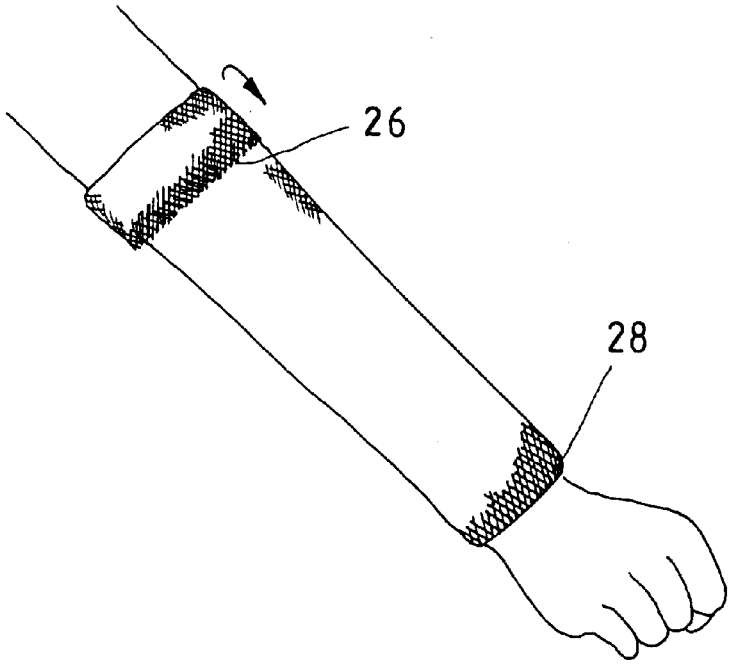
FIG. 8 shows a schematic view of a second preferred embodiment of the present invention.

As shown in FIG. 8, the method of the present invention may be modified in such a manner that the combination end 26 is folded little by little, thereby resulting in the formation of the folded portion 32 which is relatively disheveled. In addition, a plurality of elastic tubular nets 12 may be used to make a bath scrubber which is greater in density than the bath scrubber 10 described above. The elastic tubular nets 12 are fitted together.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A method for making a fruit-shaped bath scrubber, said method comprising the steps of:

(a) preparing an elastic tubular net of a length;

(b) folding an open end of the tubular net in a direction toward other open end of the tubular net such that these two open ends form a combination end, and that other end of the tubular net forms a first folding end;

(c) folding the combination end in a direction toward the first folding end;

(d) folding repeatedly a second folding end of the tubular net toward the first folding end until the tubular net is entirely folded to be located beside the first folding end;

(e) inserting a ring into the first folding end such that the ring is partially jutted out of the first folding end;

(f) putting a lashing strap through the top edge of the folded portion, the first folding end and the ring; and (g) tightening the lashing strap.

2. The method as defined in claim 1, wherein said step (a) includes a plurality of elastic tubular nets which are fitted together.

3. The method as defined in claim 1, wherein said step (b) includes a support member which is used to brace the tubular net while the folding of the open end of the tubular net takes place.

4. The method as defined in claim 1, wherein the combination end is folded in said step (c) such that the combination end is located in the proximity of the first folding end.

5. The method as defined in claim 1, wherein the tubular net is folded repeatedly in said step (d) such that the first folding end is jutted out of the folded portion of the tubular net.

* * * * *